United States Patent [19]

Barrett

[11] Patent Number: 4,756,031

[45] Date of Patent: Jul. 12, 1988

[54] AUTOMATIC TOILET FLUSHING SYSTEM

[76] Inventor: John T. Barrett, 1725 Burton St., San Diego, Calif. 92111

[21] Appl. No.: 931,225

[22] Filed: Nov. 13, 1986

[51] Int. Cl.[4] ..... E03D 5/12

[52] U.S. Cl. ..... 4/407; 4/408; 4/313

[58] Field of Search ..... 4/313, 302, 304, 305, 4/314, 330, 335, 338, 366, 367, 405–408

[56] References Cited

U.S. PATENT DOCUMENTS

| | | | |
|---|---|---|---|
| 2,341,116 | 6/1943 | Owens | 4/407 |
| 2,644,952 | 7/1953 | Boyd | 4/407 |
| 2,800,664 | 7/1957 | Bridge | 4/407 |
| 2,858,546 | 11/1958 | Tekenos et al. | 4/313 |
| 2,999,191 | 9/1961 | Muradian et al. | 317/141 |
| 3,027,567 | 4/1962 | Stahli | 4/67 |
| 3,056,142 | 10/1962 | Chin | 4/64 |
| 3,780,384 | 12/1973 | Rivelle | 4/41 |
| 3,994,029 | 11/1976 | Badders | 4/407 |
| 4,087,868 | 5/1978 | Gentz | 4/7 |
| 4,329,745 | 5/1982 | Aguero | 4/313 |

FOREIGN PATENT DOCUMENTS

| | | | |
|---|---|---|---|
| 574525 | 4/1959 | Canada | 4/367 |

*Primary Examiner*—Henry J. Recla
*Assistant Examiner*—Linda J. Sholl
*Attorney, Agent, or Firm*—Brown, Martin, Haller & Meador

[57] ABSTRACT

An automatic toilet flushing system can be used in any existing manual flush toilet and comprises a first sensor for detecting toilet use, a second sensor for detecting filling of the toilet tank to a predetermined level, and a valve actuator linked to the two sensors for opening a toilet water inlet valve in response to a signal from the first sensor and closing the inlet valve in response to a signal from the second sensor. A toilet flush operating device in the tank is connected to the supply of water flowing into the tank and comprises a hydraulic piston and cylinder, the piston moving between a retracted position and an extended position in response to water flow into the cylinder. The piston is arranged to urge a flush lever arm linked to a flush valve in the tank in a direction to open the flush valve when it moves towards its extended position.

9 Claims, 2 Drawing Sheets

AUTOMATIC TOILET FLUSHING SYSTEM

BACKGROUND OF THE INVENTION

The present invention relates to an automatic toilet flushing system for automatically flushing a toilet after each use.

Such automatic flushing systems are particularly useful in public toilets, for example in restaurants, public buildings, and so on, where users sometimes neglect to flush the toilet manually after use, resulting in an unsanitary condition for subsequent users. They may also be used for private toilets.

A standard manually flushable toilet comprises a toilet bowl connected to a toilet tank having a valve controlled water inlet for filling the tank with water, and a flush valve connecting the tank to a toilet bowl for flushing the toilet. A handle is provided on the tank for opening the flush valve. The water inlet valve is float controlled to be closed when the water reaches a predetermined level in the tank. The handle generally moves a lever arm within the tank which is connected by a chain to the flush valve, the flush valve closing automatically when the handle is released and the tank empties.

Automatic flushing devices for use with conventional toilets have been proposed in the past, but these have generally been relatively complex and expensive, and have involved substantial modification to the standard manual toilet.

One example of a previous automatic flushing device is described in U.S. Pat. No. 3,780,384 of Rivelle. In this device a seat-actuated valve provides a regulated flow of water to a flush valve operator for opening the flush valve. The seat-actuated valve is connected to the toilet water supply pipe and is "armed", or filled with water, when the tank is filling. When the valve is actuated by a user leaving the toilet seat, the water already in the valve is displaced to actuate the flush valve operator. This system is relatively complex, involving bypassing the water inlet pipe outside the toilet tank, and includes two relatively complex valve actuating mechanisms.

U.S. Pat. No. 3,056,142 of Chin shows a toilet flushing device in which a valve actuating link connected to the manual flush arm of the toilet is reciprocated by pivotal movement of a toilet seat between its raised and lowered positions. the seat is spring loaded into its raised position on removal of weight from the seat. A similar weight operated device is described in U.S. Pat. No. 4,329,745 of Aguero.

Thus, up to now automatic toilet flushing devices have generally involved relatively complex mechanical linkages which can be difficult and expensive to install. Electronic toilet flushing systems have generally been avoided since such systems were believed to require the introduction of electrical leads into the tank, which would clearly be unsafe.

SUMMARY OF THE INVENTION

According to the present invention an automatic toilet flushing system is provided which comprises a first sensor for detecting toilet use, a second sensor for detecting filling of the tank to a predetermined level, and an actuator linked to a water inlet valve controlling the flow of water into the tank for opening the valve in response to a signal from the first sensor and closing the valve in response to a signal from the second sensor.

The water inlet valve preferably comprises an electric water valve actuated by a solenoid, for example.

A flush valve operator is mounted within the tank and connected to the supply of water filling the tank, for example by a suitable bypass or diverter line connected to the tank water inlet. The operator comprises a hydraulic cylinder and a piston slidable in the cylinder between a retracted position and an extended position in which it projects out of one end of the cylinder in response to supply of water to the cylinder. The piston is arranged to operate the standard flush valve in the tank on movement into its extended position, and to release the flush valve after actuation to allow the valve to reclose in the standard fashion after the toilet is flushed.

Operation of this system is as follows. Assuming that the tank is full and the water inlet valve is closed, detection of a toilet use will open the water inlet valve. Water will then be supplied to the hydraulic cylinder, urging the piston into its extended position and opening the toilet flush valve to flush the toilet and empty the tank. The flush valve will close automatically as the tank empties, and water will continue to enter the tank and fill it via the standard fill pipe. The piston will remain in its extended position as long as water is filling the tank. Once the tank is full to the predetermined level, the second sensor will provide a signal to the valve actuator to close the water inlet valve. The piston will be biased into its retracted position, and the toilet is ready for use.

This simple and effective automatic flushing system can easily be incorporated into any existing standard toilet by first simply replacing the normal water inlet valve with a suitable electric water valve, providing a suitable sensor such as an infrared sensor or seat pressure sensor for detecting use of the toilet, and providing a control signal to the valve actuator in response to such use. A suitable water level sensor can be installed in the toilet to detect filling of the toilet to a predetermined level and to provide a further control signal to the valve actuator, and a diverter line is provided to connect the water inlet pipe in the tank in the flow of water into the hydraulic piston and cylinder for actuating the flush valve.

The flush valve operator is preferably not directly connected to the flush valve but is orientated and located such that movement of the piston out of the cylinder will urge the flush valve to open, and then release it to close freely. In one preferred arrangement the piston is arranged to urge the flush lever arm in a direction to open the flush valve, and the flush lever arm will then swing back in its return stroke to allow the flush valve to reclose. The flush lever arm can alternatively be operated manually in a conventional manner.

BRIEF DESCRIPTION OF THE DRAWINGS

The present invention will be better understood from the following detailed description of some preferred embodiments of the invention, taken in conjunction with the accompanying drawings in which like reference numerals refer to like parts and in which.

DESCRIPTION OF THE PREFERRED EMBODIMENTS

Figure 1:
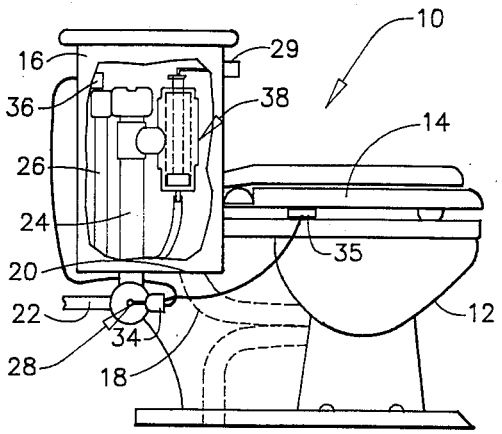
FIG. 1 is a side view of a conventional toilet, partially cut away to reveal the interior of the tank, incorporating the automatic toilet flushing system according to a preferred embodiment of the present invention.

FIG. 1 of the drawings shows a conventional type of toilet 10 comprising toilet bowl 12, seat 14 and tank 16. The tank has an outlet 18 which is connected to toilet bowl 12 in the standard manner to flush the toilet, the outlet 18 normally being closed by a standard flush valve 20 (see FIGS. 2 and 3). A water inlet pipe 22 is connected to the interior of the tank via water inlet tube 24 and fill downspout 26 for supplying water to fill the tank. A water inlet valve 28 in pipe 22 controls the supply of water to the tank.

In a conventional toilet, the flush valve is opened via an external handle 29 which is linked to the flush valve through a pivoted lever arm 30 (see FIG. 4) connected to the flush valve by a chain or line 32. In the type of toilet illustrated in FIG. 1, a downward push on handle 29 moves the free end of lever arm 30 up, raising the flush valve via chain 32 to flush the toilet.

In a conventional toilet a ballcock assembly connected to a float arm and ball is mounted at the upper end of water tube 24 for closing the inlet valve via a mechanical linkage when the tank is filled to a predetermined level. In the present invention this assembly is removed and replaced with an automatic toilet flushing system as described in more detail below.

FIGS. 1 to 4 of the drawings illustrate an automatic toilet flushing system according to a preferred embodiment of the present invention. In this system the conventional mechanically operated water inlet valve is replaced with a suitable electric water valve 28, which is suitably a solenoid operated valve actuated by means of valve actuator or solenoid 34, and sensors 35 and 36 are electrically connected to actuator 34 to control opening and closing, respectively, of inlet valve 28. The system further comprises a flush valve operator 38, described in more detail below, which is connected in the water inlet flow path and which is arranged to operate the flush valve.

The first sensor 35 is arranged to detect use of the toilet. It may, for example, comprise a suitable pressure sensor as indicated in FIG. 1 for detecting weight on the toilet seat and providing a suitable control signal to actuator 34 when the weight is removed. Alternatively an infrared detector may be utilized, for example, or a capacitative type sensor may be incorporated in the toilet seat.

The second sensor 36 is arranged to detect filling of the tank with water to a predetermined level. Sensor 36 may comprise any suitable water level sensor arranged at a suitable height within the tank, such as a capacitative probe. This sensor is also connected to actuator 34.

Figure 3A:
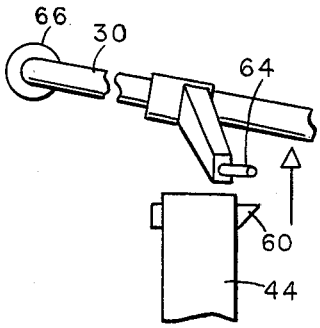
FIG. 3A is an enlarged side view of a portion of the flush valve operator.
Figure 3:
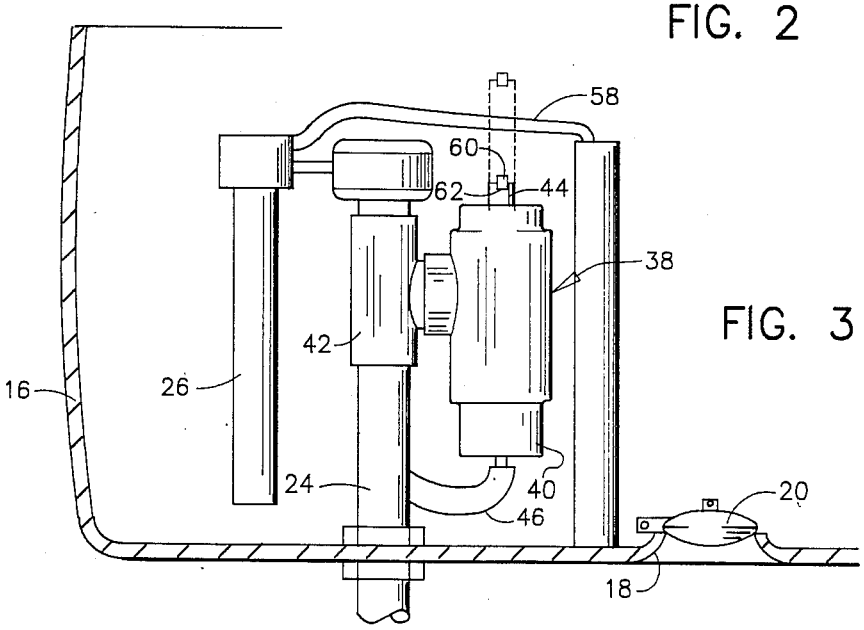
FIG. 3 is a view on the lines 3—3 of FIG. 2.

The flush valve operator 38 is mounted inside the tank for operating the flush valve. Operator 38 comprises a cylinder 40 which may be mounted on the fill or water inlet tube 24, for example, by means of mounting sleeve 42 as illustrated in FIGS. 1 and 3, and a piston 44 slidable in cylinder 40 between a retracted position shown in solid outline in FIG. 3 and an extended position shown in dotted outline in FIG. 3. The cylinder 40 has an inlet opening 45 connected via hose 46 to the water tube outlet, so that water filling the tank will also be supplied via hose 46 to the inner end of cylinder 40. Piston 44 is loaded by return spring 48 into its retracted position (see FIG. 4).

In the arrangement shown in the drawings the cylinder 40 is connected to the water inlet tube via a diverter or T-junction 50 which connects the tube outlet to both the hose 46 and to fill downspout 26 via outlets 52 and 54, respectively. Fill downspout 26 is of the conventional type and will typically contain a standard anti-siphon valve. A check valve 56 is also provided at the outlet of water tube 24. Hose 58 connects the water tube to a conventional rim wash. To install the flush valve operator, the conventional ballcock and float assembly is simply unscrewed and replaced with flush valve operator 38. Diverter 50 is screwed onto the outlet end of water tube 24, and connected to downspout 26 and cylinder inlet opening 45 via suitable connecting lines or hoses.

Figure 2:
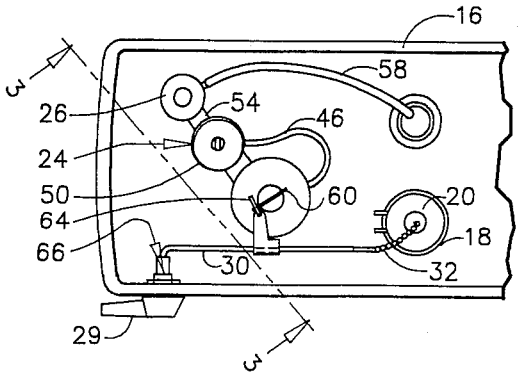
FIG. 2 is a top plan view of the toilet tank of FIG. 1 with the lid removed.
Figure 4:
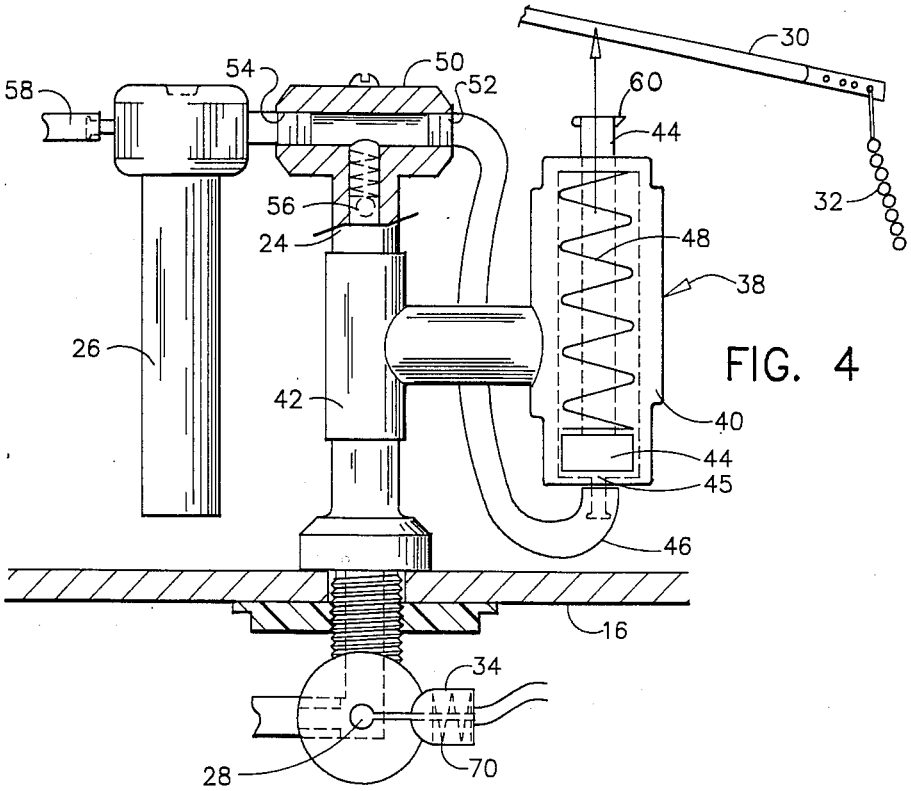
FIG. 4 is an enlarged view similar to FIG. 3 and partly cut away to show details of the flush valve operator of the automatic toilet flushing system.

Piston 44 is directed generally upwardly towards lever arm 30, as shown in FIG. 4, and has a sear or catch member 60 in an indent or cut-out 62 in the free end of the piston 44. The catch member 60 extends across the end of the piston 44 and projects radially outwardly from it at its free end, as shown in FIGS. 2 and 4. The free end of catch member 60 is aligned with either lever arm 30, as generally indicated in FIG. 4, or a suitable projecting member 64 mounted on lever arm 30 so as to extend across the path of catch member 60, as shown in FIG. 2 and the expanded view of FIG. 3A as can be seen in FIG. 2, the piston itself is offset from both the member 64 and lever arm 30, so that it will not engage or interfere with the movement of the lever arm 30 as it moves vertically upwardly or downwardly.

The catch member is arranged to be free to pivot in one direction only, so that when its free end engages the member 64 in a first, upward direction it will be held against pivoting by its mounting in slot 62 and thus will urge member 64 upwardly. When the piston and catch member move downwardly and the free end of the catch member engages member 64 from above, the member 60 will be free to pivot outwardly from indent 62 and over member 64, so that the piston can retract smoothly into the cylinder without disturbing the lever arm.

Operation of the automatic toilet flushing system described above will now be explained in more detail. When inactive, the tank 16 will normally be full to the predetermined level and the water inlet valve 28 will be closed. When a person uses the toilet, sensor 35 will detect the use, for example by reduction of pressure on the toilet seat or by other suitable sensing means, and will provide a suitable control signal to supply current to solenoid actuator 34. This will open inlet valve 28, allowing water to flow up water tube 24. The water pressure will urge check valve 56 into its open position allowing water to flow past the check valve and into diverter or T-junction 50.

Water entering diverter 50 will flow into fill downspout 26 and into cylinder 40 via hose 46. The water entering cylinder 40 will force the piston 44 out of the cylinder. As the piston moves out of cylinder 40, sear or catch member 60 will engage lever arm 30 or member 64 and lift the free end of the lever arm to pivot about mounting 66 thus also lifting the flush valve 20 via chain 32. The toilet will then flush. At the same time, as the piston continues its movement towards the fully extended position, the lever arm, which is pivotally mounted at one end 66, will naturally move in an arc free of the end of the sear 60, which continues to move vertically upwards in a straight line. Thus, when the system is viewed in FIG. 2, upward movement of arm 30 will also move member 64 to the left out of alignment with sear 60. At this point, valve 20 will be open and prevented from closing by water flowing out of the tank.

Once the tank is emptied, the flush valve will reclose and pull the lever arm back to its normal position. Meanwhile water will continue to flow into the tank via tube 24 and downspout 26, and the piston will be held in its extended position by the water pressure.

When the water level reaches the water level sensor 36, a second signal will be transmitted to shut off current to the actuator 34. Valve 26 will then close by the action of a suitable return spring 70. This will cut off the water supply to cylinder 40, and the piston will be urged by spring 48 back into its retracted position. As it moves back, sear 60 will contact lever arm 30 or projecting pin member 64 from the opposite direction and pivot outwardly from indent 62 to pass over the lever arm, falling back into its natural, gravity cocked position in indent 62 once it is free of the lever arm.

Thus, a simple and inexpensive automatic toilet flushing system can be provided by using a solenoid actuated water inlet valve linked to a suitable toilet use sensor and water level sensor, and by directing incoming water flow to operate a hydraulic flush valve operator within the tank to open the flush valve and empty the tank. Although in the embodiment illustrated the operator piston acts directly on the lever arm linked to the manual flush handle, it may be arranged in any suitable manner to lift the flush valve and subsequently release it for reclosure once the tank has emptied.

Figure 5:
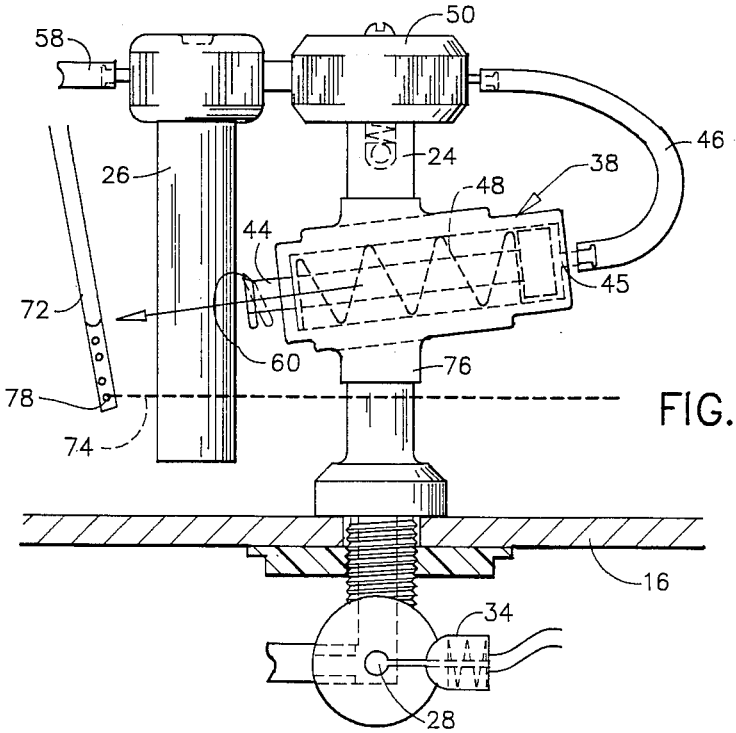
FIG. 5 is a view similar to FIG. 4 showing a modified embodiment of the invention.

FIG. 5 of the drawings shows a modification for use in toilets having a different type of manual flush actuator. In FIG. 5 the basic components of the toilet flushing system are equivalent to those of FIGS. 1 to 4, and like reference numerals have been given to like parts.

The system of FIG. 5 is for use in toilets having push button type flush actuators, in which pushing of a button in the side wall of the tank urges the lower end of lever arm 72 to the left, pulling up the flush valve (not shown in FIG. 5) via connecting line or chain 74. In this type of toilet the flush valve operator 38 is mounted generally horizontally rather than vertically on the water tube 24 via mounting sleeve 76, and piston 44 is directed generally towards the lower end of lever arm 72. The piston is preferably arranged to engage a pin 78 (not shown), which extends transversely through the lower end of lever arm 72 and transversely to the direction of movement of piston 44, when it moves towards its extended position.

As in the previous embodiment, a pivotally mounted sear or catch member 60 at the free end of the piston is arranged to be free to pivot in one direction only about its pivot pin (anticlockwise as viewed in FIG. 5). As the piston moves outwardly from its cylinder, the projecting pointed or toothed end of the catch member will engage a pin 78 projecting from lever arm 72. The catch member is held against rotation in a clockwise direction, and thus will urge pin 78 and arm 72 to the left. The pin 78 will then swing in an arc past sear 60 to allow the piston to move freely into its extended position beyond lever arm 72. When the piston retracts on closure of inlet valve 28, the sear or catch member will be free to pivot in an anti-clockwise direction when its free end engages pin 78, passing freely over the pin, as indicated in dotted outline in FIG. 5.

Operation of the embodiment shown in FIG. 5 is otherwise identical to that of the first embodiment shown in FIGS. 1 to 4. Clearly the system can be modified to any type of toilet which is normally manually operated, simply by locating the flush valve operator to urge the flush valve into an open position, and may be installed easily on existing toilets or incorporated in new toilets during manufacture.

Installation is very simple and inexpensive and does not involve any major modification of the existing system. All that is required is the replacement of the standard inlet valve with a suitable electric water valve, the installation of a suitable toilet use sensor and water level sensor, which are suitably electrically connected to the inlet valve actuator to control opening and closing, respectively, of the inlet valve in a manner which will be understood by those skilled in the field. Inside the tank the ballcock and float assembly is simply unscrewed and replaced with the screw on flush valve operator assembly including piston and cylinder 44, 40 and diverter 50.

Thus a reliable, relatively inexpensive and simple automatic toilet flushing system is provided.

Although some preferred embodiments of the invention have been described above by way of example only, it will be understood by those skilled in the field that modifications may be made to the disclosed embodiments without departing from the scope of the invention, which is defined by the appended claims.

I claim:

1. An automatic toilet flushing system, comprising:

first sensor means for detecting use of a toilet and for providing a first control signal in response to use of the toilet;

second sensor means for detecting a predetermined water level in a toilet tank and for providing a second control signal in response to detection of the predetermined water level;

an inlet valve for controlling water flow into the toilet tank water inlet;

valve actuator means linked to said first and second sensor means for operating the water inlet valve, the actuator means comprising means for opening the water inlet valve in response to said first control signal and closing the water inlet valve in response to said second control signal;

toilet flush operator means for opening a flush valve in the tank to flush the toilet, the operator means comprising a cylinder having an inlet opening for connection to a water inlet to the tank, a piston slidably mounted in the cylinder and moveable between a retracted position and an extended position in which it projects out of the cylinder in response to the supply of water to the tank water inlet, and bias means for urging the piston towards its retracted position;

the piston having a catch member at its outer end for urging a flush valve member linked to said flush valve in a first direction during movement of the piston towards its extended position to urge the toilet flush valve into its open position, for releasing the flush valve member to allow it to move in a second direction to close the flush valve when the piston is fully extended, and for passing freely over the flush valve member during movement of the piston towards its retracted position.

2. The system as claimed in claim 1, wherein the flush valve operator further includes mounting means for mounting the cylinder within a toilet tank and directing the catch member towards the flush valve member linked to an external actuator for manually opening the flush valve, and diverter means downstream of said inlet valve for permanently connecting a water inlet tube in the toilet tank to the cylinder inlet for diverting some of the water flow into the tank into the cylinder.

3. The system as claimed in claim 2, wherein the inlet valve is connected to said water inlet tube to control water flow into the toilet tank and into the cylinder, and comprises means for controlling the supply of water to both the tank and the cylinder to move the piston into its extended position whenever water is being supplied to the toilet tank and to allow the piston to retract whenever the water supply to the tank is cut off by closure of the inlet valve.

4. The system as claimed in claim 1, wherein said piston has an indent at its outer end, and said catch member is pivotally mounted in said indent to project radially outwardly from said outer end and to be free to pivot in one rotational direction only.

5. The system as claimed in claim 1, wherein said valve actuating means comprises a solenoid.

6. The system as claimed in claim 1, wherein said mounting means comprises sleeve means for engaging around the water inlet tube to the toilet tank.

7. The system as claimed in claim 6, wherein said cylinder is oriented parallel to said sleeve means so that said piston is directed vertically upwardly.

8. The system as claimed in claim 6, wherein said cylinder is oriented transverse to said sleeve means.

9. The system as claimed in claim 1, including a flush valve member linked to the flush valve for opening the flush valve when urged in a first direction, the flush valve member having a pin member projecting transversely from it, and the catch member on the piston projecting radially outwardly from the piston and into alignment with said pin member when the flush valve member is in an inoperative position, the piston being offset from the valve member so that it moves freely past the valve member when moving between its retracted and extended positions as the catch member engages said pin member.

* * * * *